United States Patent [19]

De Mattei et al.

[11] 4,292,145

[45] Sep. 29, 1981

[54] ELECTRODEPOSITION OF MOLTEN SILICON

[75] Inventors: Robert C. De Mattei, Sunnyvale; Dennis Elwell, Palo Alto; Robert S. Feigelson, Saratoga, all of Calif.

[73] Assignee: The Board of Trustees of Leland Stanford Junior University, Stanford, Calif.

[21] Appl. No.: 149,567

[22] Filed: May 14, 1980

[51] Int. Cl.[3] ..... C25B 1/00

[52] U.S. Cl. ..... 204/60

[58] Field of Search ..... 204/60

[56] References Cited

U.S. PATENT DOCUMENTS 3,405,043 10/1968 Barakat et al. ..... 204/60

*Primary Examiner*—Howard S. Williams

*Attorney, Agent, or Firm*—Flehr, Hohbach, Test, Albritton & Herbert

[57] ABSTRACT

Silicon dioxide is dissolved in a molten electrolytic bath, preferably comprising barium oxide and barium fluoride. A direct current is passed between an anode and a cathode in the bath to reduce the dissolved silicon dioxide to non-alloyed silicon in molten form, which is removed from the bath.

19 Claims, No Drawings

ELECTRODEPOSITION OF MOLTEN SILICON

The Government has rights in this invention pursuant to Contract No. DOE EY-76-5-03-0326 PA 67, awarded to the U.S. Department of Energy.

This invention relates to the electrodeposition of high purity silicon from a silica source.

Silica has been dissolved in an electrolytic salt bath and reduced to silicon by electrolysis for various end uses. For example, for silicon purities on the order of 98%, the silicon is of a metallurgical grade. At higher purities, e.g., 99.9% and above, the silicon is useful for solar cells and possibly for electronic devices.

In the known techniques for electrodeposition of silicon, the silicon is deposited at the cathode in solid form. The deposition of silicon in the solid state is limited by the onset of dendritic growth, leading to overall low deposition rates. Another disadvantage of deposition in the solid state is that the morphology of its formation must be carefully controlled to provide repeatable properties in solar cell and electronics devices. Furthermore, impurities tend to become entrained in the solid state silicon.

One technique of refining silicon is described in Monnier et al. U.S. Pat. No. 3,254,010. There, the patentee suggests the use of a molten anode comprising a liquid alloy of silicon and a nobler metal such as copper. The patent states that it is not practical to maintain the cell at a temperature high enough to maintain such silicon in a molten condition. There is no disclosure of depositing the silicon in liquid form.

Another technique is disclosed in which silicon is formed at the cathode in M. Dodero, Bull. Soc. Chem. Franc. 6 (1939, p. 209). In this system, alloys of silicon with calcium, barium or strontium are produced in which silicon is dissolved. The temperature of operation is well below the melting point of silicon and so this system is not capable of forming unalloyed molten silicon by itself.

It is an object of the invention to provide a system for the efficient, rapid electrowinning of high purity silicon from an inexpensive source (silica).

It is a particular object of the invention to provide an electrodeposition technique of the foregoing type capable of producing silicon at the high purities required for solar cells and electronic devices.

Further objects and features of the invention will be apparent from the following description taken of its preferred embodiment.

In accordance with the above objects, it has been found that silicon can be reduced from silicon dioxide by electrolysis in an electrolytic salt bath maintained at a temperature above that at which the silicon is molten. In this manner, the molten silicon is formed at a high rate of production without the formation of molten salt inclusions or other impurities which tend to occur when silicon is deposited in the solid state. The preferred electrolytic salt bath is a mixture of barium oxide and barium fluoride. It is believed that the silica reacts with the barium oxide to form barium silicate, from which the silicon is electrodeposited.

In the method of the present invention, silicon dioxide is dissolved in an electrolytic salt bath. A direct current is passed between an anode and a cathode in the bath to reduce the dissolved silicon dioxide to a product consisting essentially of non-alloyed silicon. An important feature of the invention is that the bath is maintained at a temperature above the melting point of silicon (in excess of 1420° C.) so that the reduced silicon is in molten form during formation. Thereafter, the reduced silicon is removed from the electrolytic salt bath and solidified.

A variety of sources of silicon dioxide may be utilized in accordance with the present invention. Inexpensive sources of amorphous silica include diatomaceous earth.

In the first step of the process, silicon dioxide is dissolved in a molten electrolytic salt bath. One preferred component of the salt bath is an alkaline earth or alkali oxide, specifically barium oxide. A common inexpensive source of barium oxide is barium carbonate, which decomposes to form the barium oxide and gaseous carbon dioxide at elevated temperatures. For simplicity of description, barium oxide will be referred to as an alkaline earth oxide component of the electrolyte system of the present invention. It is believed that, in addition, other alkaline earth oxides (e.g. calcium or strontium) or alkali metal oxides (e.g., sodium, lithium, or potassium) may be utilized in place of the barium oxide component.

It is believed that the silicon dioxide reacts with the barium oxide to form barium silicate, from which the silica is reduced during electrolysis. Should a source of barium silicate become available, the electrolysis could be formed directly from this product rather than by separately feeding the barium oxide and silicon dioxide. The advantage of using the separate components is that they are inexpensive and readily available.

Another component of the electrolytic salt bath is a metal fluoride, preferably formed of the same metal as the oxide, specifically barium. The fluoride tends to reduce the melting point of the bath, thereby permitting operation at lower temperatures. In addition, the fluoride reduces the viscosity of the molten bath, which facilitates dissolution of the silica and electrodeposition of the silicon.

There are a number of significant advantages in forming the silicon in the liquid state. One advantage is that the cohesive forces of the liquid drive solvent remnants out of the liquid, permitting the formation of a high purity silicon product. In that regard, while metallurgical grade silicon in excess of 98% pure may be formed, more importantly, silicon of solar cell purity in excess of 99.9% pure may be formed. Another related advantage is that the morphology of formation to eliminate the solvent is not a limitation on the rate of silicon formation as it is when silicon is formed in the solid state. Thus, the process can be performed at a significantly faster rate when the silicon is formed in the liquid state rather than the solid state.

The selection of a proper electrolytic salt bath to provide effective molten silicon reduction is an important aspect of the invention. It is preferable that the bath be stable and nonvolatile at the temperature of electrolysis, in excess of 1420° C., and typically from 1450° C, to 1500° C. Thus, the salt should be molten at a temperature not significantly below operating temperatures (e.g. 1000°-1400° C.). While higher operating temperatures could be employed, it is less economical to do so, and such extreme temperatures can cause operating problems. In addition, the silicon dioxide must be soluble in the salt bath. If one of the bath components is volatile, a ceiling over the bath may be provided to contain a component of electrolytic salt which volatilizes. Another advantageous feature of the salt bath would be its capability of reuse and of continuous operation.

A preferred electrolytic salt bath is a combination of alkaline earth oxide and alkaline earth fluoride formed of the same alkaline earth metal. A particularly effective salt bath is formed of barium oxide and barium fluoride, wherein the silicon dioxide reacts with the barium oxide to form barium silicate. While barium carbonate is disclosed as one source of barium oxide, it should be understood that other sources may be employed which decompose to barium oxide, such as barium nitrate. The barium oxide-barium fluoride system is particularly effective because it is thermodynamically stable, has good solubility for silica, and melts just below the melting point of silica.

The ratio of barium oxide to barium fluoride in the electrolytic salt bath may vary over a wide range. The amount of barium fluoride should be sufficient to provide the desired lowering of the melting point of the bath and reduction in viscosity to facilitate dissolution of the silicon dioxide in the bath for ready reaction with the barium oxide to form barium silicate. In general, a molar ratio of barium oxide to barium fluoride of 0 to 3 parts of the former to 1 part of the latter may be employed, with a preferred range of 0.5 to 2 parts of the former to 1 part of the latter.

The proportion of silica to be added to the electrolytic salt bath may also vary over a wide range. Increasing the silica content also increases the rate. However, it also has the undesirable property of increasing the viscosity of the salt bath and also its melting point. Thus, the concentration of silica is selected as a compromise to maximize the rate of deposition without causing excessive viscosity or operating temperatures. In that regard, a molar ratio of silica to electrolyte of about 0.5 to 3.0 parts of the former to 1 part of the latter is suitable, while 1.5 to 2.0 parts of the former to 1 part of the latter is preferable.

It is preferable to form both the anode and cathode of a material which is relatively inert to the conditions of operation. Graphite has been found to be particularly suitable for this purpose. Separate anodes and cathodes may be used or the crucible itself may be used as the anode during deposition. In that event, a graphite crucible is preferable. Other materials could be used for the crucible or electrodes, such as silicon nitride, so long as they are inert to the conditions of operation.

The molten silicon product typically forms first into droplets. However, such droplets can cohere into a layer. Depending upon the relative densities of such silicon and the melt, the silicon will either float to the surface, sink to the bottom of the crucible, or float submerged in the melt. In the barium oxide-barium fluoride system, the reduced silicon tends to float submerged in the melt. The mode of removal of silicon from the melt will vary depending upon its position in the melt. If the silicon floats, it can be collected as a pool around the cathode. As further silicon deposits, the cathode can be withdrawn vertically so that a crystal, or polycrystaline boule, is "pulled" as in the Czochralski method used for growing silicon in the electronics industry. Alternatively, a twinned dendrite seed may be used to contact the melt and a silicon sheet of "web" morphology reduced as the seed is raised, as set out in R. G. Seidensticker et al., Proceedings of the Eleventh IEEE Photovotaic Specialists Conference, 1975. Another possibility is to use a cathode shaped to encourage capillary flow of the molten silicon, and a sheet or other shape grown as the "edge-defined, film-fed" (EFG) method, as described in B. Chalmers, et al., Journal of Crystal Growth, Vol. 13/14, 1972, p. 84.

Should any components of the melt be volatile, a layer of molten silicon covering the top of the melt could be used to effectively control evaporation of such volatile species.

In this instance, the anode would be located in a separate compartment so that the evolved gas would not interact with this layer of silicon. Removal of silicon could still occur by any of the aforementioned techniques.

If the density of the melt is lower than that of silicon, so that the silicon sinks, the product could be withdrawn to form a sheet for direct use in solar cells, or grown directly into a single crystal form by inverting the aforementioned procedures (to produce web, sheet or ribbon).

As set out above, exceptionally pure silicon may be formed in accordance with the present invention, e.g., less than 10 ppm impurities. Certain sources of silica include impurities, specifically iron, in excess of this amount. In such instances, it is frequently desirable to pre-electrolyze at a potential at which the iron plates out on the cathode but not the silicon. Then, the cathode is removed from the system and the reduction of silicon is performed. Alternately, the iron could be leached out with acid prior to reduction of the silicon.

A wide range of current densities may be employed in accordance with the present invention, depending upon the desired rate of electrodeposition. Thus, for example, 0.5 to 1 A/cm$^2$ to 10 A/cm$^2$ or higher may be employed.

A further disclosure in the nature of the present invention is provided by the following specific examples of its practice. It should be understood that the data disclosed serve only as examples and are not intended to limit the scope of the invention.

EXAMPLE 1

A charge of 35.4 g silicon dioxide, 40.8 g barium carbonate, and 23.8 g barium fluoride is placed into a graphite crucible. The crucible is inserted into a furnace and heated to about 400° C. in a vacuum to remove traces of moisture. An inert gas (argon) is then flowed into the furnace, which is heated to its operating temperature of about 1450° C.–1500° C. At this point the barium carbonate decomposes to barium oxide and carbon dioxide gas, which is removed in a flow of argon. After the charge is melted, it is homogenized for about 30 to 60 minutes. A spaced graphite anode and cathode are then inserted into the melt, which is electrolyzed at 1.7–1.8 volts with a current of 500 mA - 1 A.

At an average current of 700 mA, the theoretical deposition rate is 0.21 g/hr. The actual deposition rate is on the order of about 0.03 g/hr. at an efficiency on the order of 15%.

EXAMPLE 2

A charge of 63.2 mole % silica, 22.2 mole % barium carbonate, and 14.5 mole % barium fluoride were placed into a graphite crucible and processed prior to electrolysis, as set out above. In this instance, a graphite cathode was used in combination with the graphite crucible as the anode. The current employed was 1.75 volts at 240–480 mA, at a current density of about 100–200 mA/cm$^2$. Electrolysis continued for 12 hours at 1450° C.

Silicon is produced in discrete liquid droplets of a purity of approximately 99.98%. The droplets are composed of multiple grains.

EXAMPLE 3

A charge 58.7 mole % silica, 20.6 mole % barium carbonate, and 20.6 mole % barium fluoride are placed into a graphite crucible and pretreated prior to electrolysis, as set out above. Graphite anodes and cathodes are placed into the melt and current is flowed at 120–940 mA and a current density of about 50 to 400 mA/cm$^2$. Electrolysis continued for 7 hours at 1440° C.

Silicon is produced in discrete droplets similar to that of Experiment 2. Droplets are smaller and more numerous.

EXAMPLE 4

A melt comprising 68.4 mole % silica, 23.5 mole % barium carbonate, and 8.2 mole % barium fluoride is placed into a graphite crucible and processed prior to electrolysis, as set forth above. A current of 120 mA is passed between a graphite cathode and anode at 1.8 volts, 120 mA current, and a current density of about 50 mA/cm$^2$. Electrolysis continued for 15 hours at a temperature of 1450° C.

Silicon is produced in small discrete droplets in the vicinity of the cathode.

EXAMPLE 5

A charge of 63.2 mole % silica, 22.2 mole % barium carbonate, and 14.5 mole % barium fluoride is placed into a graphite crucible and processed prior to electrolysis, as set out in Example 1. A current of 16 volts and 2.0 mA is passed for 12 hours at 1450° C. In this higher current experiment, larger droplets of silicon are formed.

What is claimed is:

1. A method of reducing silicon dioxide to silicon in molten form by electrodeposition comprising:

(a) dissolving silicon dioxide in a molten electrolytic salt bath, (b) passing a direct current between an anode and a cathode in the electrolytic salt bath to reduce said dissolved silicon dioxide to a product consisting essentially of non-alloyed silicon, said bath being maintained at a sufficiently high temperature in excess of 1420° C. for said thus-formed reduced silicon to be in molten form, said electrolytic salt bath being stable at said maintained temperature, and (c) removing said reduced silicon from said electrolytic salt bath, said silicon being essentially free from bath salt inclusions.

2. The method of claim 1 in which said electrolytic salt comprises an alkaline earth fluoride.

3. The method of claim 1 in which said electrolytic salt also includes an alkaline earth oxide.

4. The method of claim 3 in which the alkaline earth metal consists essentially of a single metal.

5. The method of claim 4 in which said single metal is barium.

6. The method of claim 1 in which said electrolytic salt comprises a mixture of barium silicate and barium fluoride.

7. The method of claim 6 in which said barium silicate is formed by in situ reaction of barium oxide and silica.

8. The method of claim 1 in which said electrolytic salt bath comprises a mixture of barium oxide and barium fluoride.

9. The method of claim 8 in which the molar ratio of said barium oxide to barium fluoride is from 0.5 to 2.0 parts of the former to one part of the latter.

10. The method of claim 1 in which the molar ratio of said silicon dioxide to said electrolyte is from about 0.5 to 3.0 parts of the former to one part of the latter.

11. The method of claim 1 in which said reduced silicon forms as a continuous separate molten silicon phase.

12. The method of claim 1 in which said anode and cathode are essentially inert at the operating conditions.

13. The method of claim 1 in which said anode and cathode are formed of graphite.

14. The method of claim 1 in which said silicon is removed from said electrolytic salt bath by drawing a solid crystal therefrom.

15. The method of claim 1 in which said reduced silicon is at least 98% pure.

16. The method of claim 1 in which said reduced silicon is at least 99.9% pure.

17. The method of claim 1 together with the step of refining said reduced silicon.

18. The method of claim 1 in which said thus-formed molten silicon floats in said electrolytic salt bath.

19. The method of claim 1 in which said silicon collects as a pool which is removed from said electrolytic salt bath.

* * * * *